US005157730A

United States Patent [19]

Liu

[11] Patent Number: 5,157,730

[45] Date of Patent: Oct. 20, 1992

[54] PULSE RATE MODULATION TYPE PIEZOELECTRIC CRYSTAL DRIVER DEVICE

[75] Inventor: Liang-Yuan Liu, Hsin-Chu City, Taiwan

[73] Assignee: Hualon Microelectrics Corporation, Hsin-Chu, Taiwan

[21] Appl. No.: 776,977

[22] Filed: Oct. 15, 1991

[51] Int. Cl.[5] ..... H04R 3/00

[52] U.S. Cl. ..... 381/111; 381/190; 310/317

[58] Field of Search ..... 381/111, 117, 116, 190, 381/104, 109, 173; 340/384 Z; 310/317

[56] References Cited

U.S. PATENT DOCUMENTS 3,947,708 3/1976 Fulenwider ..... 381/173
5,019,819 5/1991 Kimura ..... 341/137

FOREIGN PATENT DOCUMENTS 0194596 11/1984 Japan ..... 381/117

*Primary Examiner*—Forester W. Isen
*Assistant Examiner*—Nina Tong
*Attorney, Agent, or Firm*—Ladas & Parry

[57] ABSTRACT

In a pulse rate modulation type driver device for driving a piezoelectric crystal so as to produce sound, a digitized sound signal input having a sign bit and a plurality of magnitude bits is firstly provided. A driving signal is then generated by varying the pulse density per unit time of a clock pulse according to the value of the magnitude bits. The driving signal is more dense when the value of the magnitude bits is higher and is less dense when the value of the magnitude bits is lower. The driving signal is then applied to the piezoelectric crystal so as to permit the piezoelectric crystal to undergo mechanical strain and thereby produce sound. The driving signal is applied to either a positive terminal or a negative terminal of the piezoelectric crystal depending upon the logic state of the sign bit of the digitized sound signal input.

4 Claims, 3 Drawing Sheets

PULSE RATE MODULATION TYPE PIEZOELECTRIC CRYSTAL DRIVER DEVICE

BACKGROUND OF THE INVENTION

1. Field of the Invention

The invention relates to a piezoelectric crystal driver device, and more particularly to a pulse rate modulation type method and driver device for driving a piezoelectric crystal.

2. Description of the Related Art

Piezoelectric crystals are widely used in microphones, loudspeakers, sound pick-up devices, buzzers, etc. The piezoelectric crystal expands or bends whenever a signal voltage is applied thereto. This deflection results in the generation of an appropriate sound output.

The conventional method used in driving piezoelectric crystals is as follows: A digitized sound signal input (such as speech, music, etc.) is converted into an appropriate analog signal via a digital-to-analog converter means. The analog signal is then applied onto the terminals of the piezoelectric crystal, causing the piezoelectric crystal to vibrate and thereby produce sound.

SUMMARY OF THE INVENTION

Therefore, the objective of the present invention is to provide a piezoelectric crystal driver device which uses a different method to drive the piezoelectric crystal.

More specifically, the objective of the present invention is to provide a pulse rate modulation type piezoelectric crystal driver device having a pulse output that is to be applied to a piezoelectric crystal. The pulse density per unit time of the pulse output varies according to the magnitude of a digitized sound signal input. If the magnitude of the digitized sound signal input is higher, the pulse density is correspondingly denser. A decrease in the magnitude of the digitized sound signal input correspondingly reduces the pulse density.

The difference between the conventional piezoelectric crystal driver device and the driver device of the present invention is as follows: Referring to FIG. 1A, a digitized sound signal input is shown to comprise four four-bit data bytes: 0000, 1010, 0011 and 1111. Referring to FIG. 1B, the output of the conventional driver device is a varying analog voltage (0 V, 10/15 V, 3/15 V, 1 V) which corresponds to the magnitude of the data bytes. Referring to FIG. 1C, the output of the driver device of the present invention is a pulse train, the pulse density per unit time of the pulse train being varied in accordance with the magnitude of the data bytes. There are 0 pulses per unit time if the data byte is 0000, (n*10) pulses per unit time if the data byte is 1010, (n*3) pulses per unit time if the data byte is 0011, and (n*15) pulses per unit time if the data byte is 1111.

Referring to FIG. 2, the principle of the preferred embodiment of a pulse rate modulation type piezoelectric crystal driver device according to the present invention is as follows: A sound source (S) has a digitized sound signal output (such as speech, music, etc.). The positive values of the digitized sound signal output are received by a first pulse rate modulator (M1), while the negative values of the digitized sound signal output are received by a second pulse rate modulator (M2). The first and second pulse rate modulators (M1, M2) vary the pulse density per unit time of the clock pulse output of a pulse generator (P) according to the magnitude of the digitized sound signal input. The outputs of the first and second pulse rate modulators (M1, M2) are then applied to the terminals of a piezoelectric crystal (B) to permit the latter to undergo mechanical strain and thereby produce sound.

BRIEF DESCRIPTION OF THE DRAWINGS

Other features and advantages of the present invention will become apparent in the following detailed description of the preferred embodiments with reference to the/accompanying drawings, of which.

DETAILED DESCRIPTION OF THE PREFERRED EMBODIMENTS

Figure 1A:
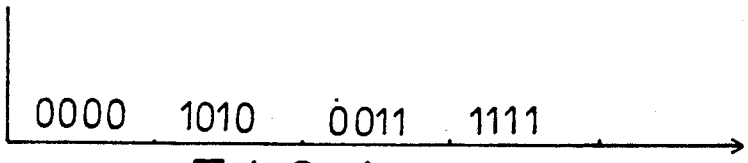
FIG. 1A shows four four-bit data bytes of a sample digitized sound signal input used to illustrate the difference between the driver device of the present invention and the prior art.
Figure 1B:
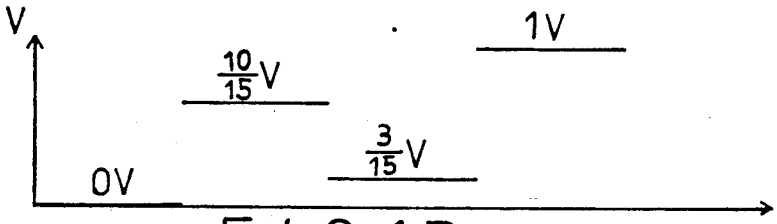
FIG. 1B (PRIOR ART)
FIG. 1B illustrates that the output of the conventional driver device is a varying analog voltage which corresponds to the magnitude of the data bytes shown in FIG. 1A.
Figure 1C:
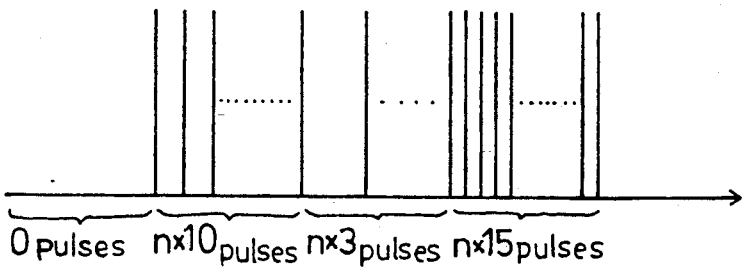
FIG. 1C shows that the output of the preferred embodiment of a pulse rate modulation type piezoelectric crystal driver device according to the present invention is a pulse train, the pulse density per unit time of the pulse train being varied according to the magnitude of the data bytes shown in FIG. 1A.
Figure 2:
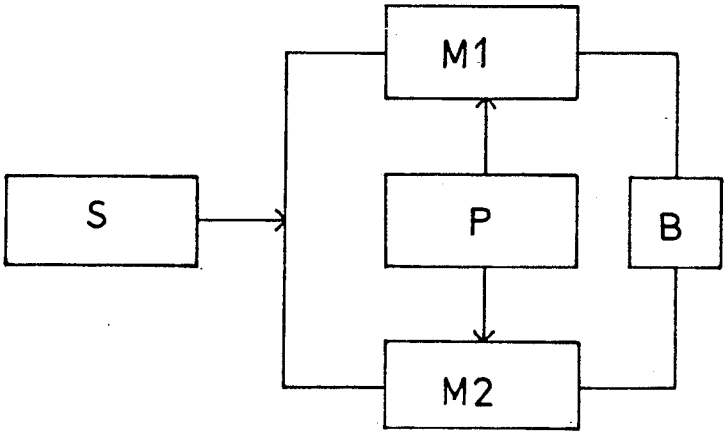
FIG. 2 is schematic block diagram of the preferred embodiment of a pulse rate modulation type piezoelectric crystal driver device according to the present invention.
Figure 3:
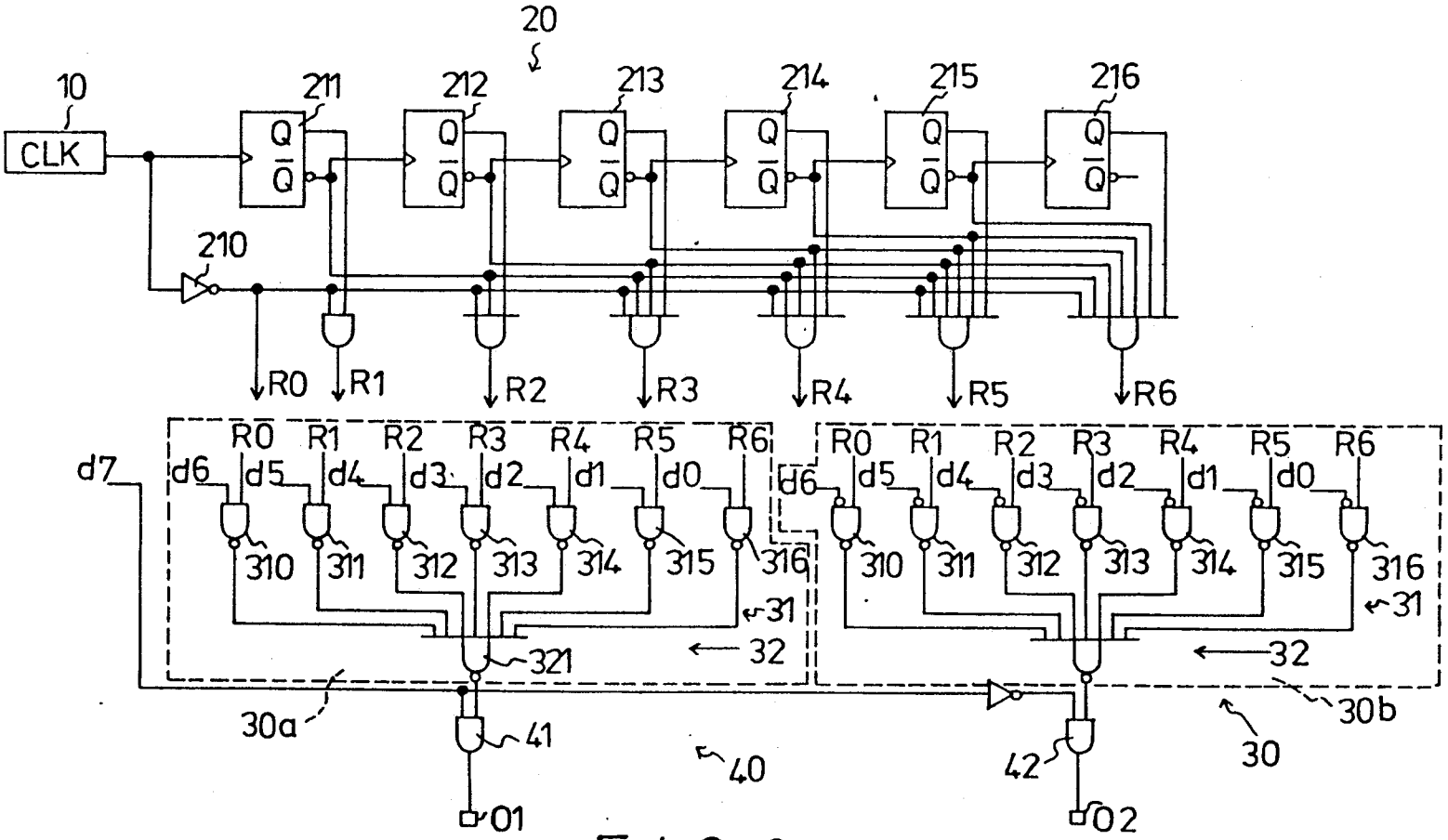
FIG. 3 is a schematic electrical circuit diagram of the first preferred embodiment of a pulse rate modulation type piezoelectric crystal driver device of the present invention.

Referring to FIG. 3, the first preferred embodiment of a pulse rate modulation type piezoelectric crystal driver device receives an 8-bit digitized sound signal input (d7–d0) and comprises a pulse train generator means (10), a multi-step frequency divider means (20), a mixing circuit means (30) and an output select circuit means (40). The most significant bit (d7) of the digitized sound signal input is a sign bit. The magnitude of the digitized sound signal input is indicated by the remaining bits (d6–d0).

The pulse train generator means (10) produces a clock pulse output having a clock frequency (f). The multi-step frequency divider means (20) includes an inverter (210) serving as a unity divider circuit, and six cascaded flip-flop means (211–216). The input of the first flip-flop means (211) is connected to the pulse train generator means (10). The multi-step frequency divider means (20) has seven pulse outputs (R0–R6), each of which corresponds to one of the magnitude bits (d6–d0) of the digitized sound signal input. The values of the pulse outputs (R1–R6) as a function of the clock frequency (f) are as follows:

R1$=\frac{1}{2}$ f Hz
R2$=\frac{1}{4}$ f Hz
R3$=\frac{1}{8}$ f Hz
R4$=1/16$ f Hz
R5$=1/32$ f Hz
R6$=1/64$ f Hz The pulse output (R0) is equal to the clock frequency (f), but is 180° out of phase. The pulse outputs (R0–R6) of the multi-step frequency divider means (20) provide the different pulse signals required to accomplish the pulse rate modulation technique used by the present invention.

The mixing circuit means (30) includes positive and negative mixer circuits (30*a*, 30*b*). The positive mixer circuit (30*a*) receives the magnitude bits (d6–d0) of the digitized sound signal input. The logic states of the magnitude bits (d6–d0) are inverted before they are received by the negative mixer circuit (30*b*). The pulse outputs (R0–R6) are also received by both the positive and negative mixer circuits (30*a*, 30*b*).

Each of the positive and negative mixer circuits (30*a*, 30*b*) includes a first circuit stage (31) and a second circuit stage (32). The first circuit stage (31) comprises seven, two-input NAND logic means (310–316). Each of the NAND logic means (310–316) has one of the magnitude bits (d6–d0) and one of the pulse outputs (R0–R6) as inputs thereto. The second circuit stage (32) comprises a seven-input NAND logic means (321) which is connected to the outputs of the NAND logic means (310–316). The magnitude bits (d6–d0) control which of the pulse outputs (R0–R6) should be present at the input ports of the NAND logic means (321). The NAND logic means (321) superimposes the pulse outputs (R0–R6) present at its input ports, thereby generating a corresponding pulse arrangement for a particular value of magnitude bits (d6–d0). This illustrates how the preferred embodiment accomplishes pulse rate modulation.

The input select circuit means (40) includes first and second two-input AND logic means (41, 42). The first AND logic means (41) receives the output of the positive mixer circuit (30*a*) and the sign bit (d7) of the digitized sound signal input. The second AND logic means (42) receives the output of the negative mixer circuit (30*b*) and the inverted sign bit (d7) of the digitized sound signal input.

When the sign bit (d7) is a logic "1", the first AND logic means (41) sends the output of the positive mixer circuit (30*a*) to the positive terminal (ol) of the piezoelectric crystal. The output of the second AND logic means (42) is alogic "0".

When the sign bit (d7) is a logic "0", the second AND logic means (42) sends the output of the negative mixer circuit (30*b*) to the negative terminal (o2) of the piezoelectric crystal. The output of the first AND logic means (41) is alogic "0". The electric signals applied to the piezoelectric crystal permit the latter to undergo mechanical strain and thereby produce sound.

The value of the magnitude bits (d6–d0) determines the density and spacing of the driving pulse signal output of the driver device. The sign bit (d7) is used to indicate whether or not the polarity of the digitized sound signal input is positive or negative. Assuming that the digitized sound signal input is 00101101, the corresponding driving signal generated by the preferred embodiment is as follows: $(0*1\ f\ Hz)+(1*\frac{1}{2}\ f\ Hz)+(0*\frac{1}{4}\ f\ Hz)+(1*\frac{1}{8}\ f\ Hz)+(1\ *\ 1/16\ f\ Hz)+(0*1/32\ f\ Hz)+(1*1/64\ f\ Hz)=45/64\ f\ Hz$ applied to the negative terminal (o2) of the piezoelectric crystal.

The piezoelectric crystal requires a minimum operating frequency (fo Hz) in order to produce sound. When selecting the clock frequency (f) for the pulse train generator means (10), it is important to note that the smallest pulse output (R6), which is 1/64 f Hz, must be sufficient to drive the piezoelectric crystal so as to control the latter to generate sound. Thus, the clock frequency (f) must be greater than 64 fo Hz. The formula for finding the required clock frequency (f) for an N-bit digitized sound signal input is as follows:

$$f=2\ exp\ (N-2)\ fo\ Hz$$

Figure 4:
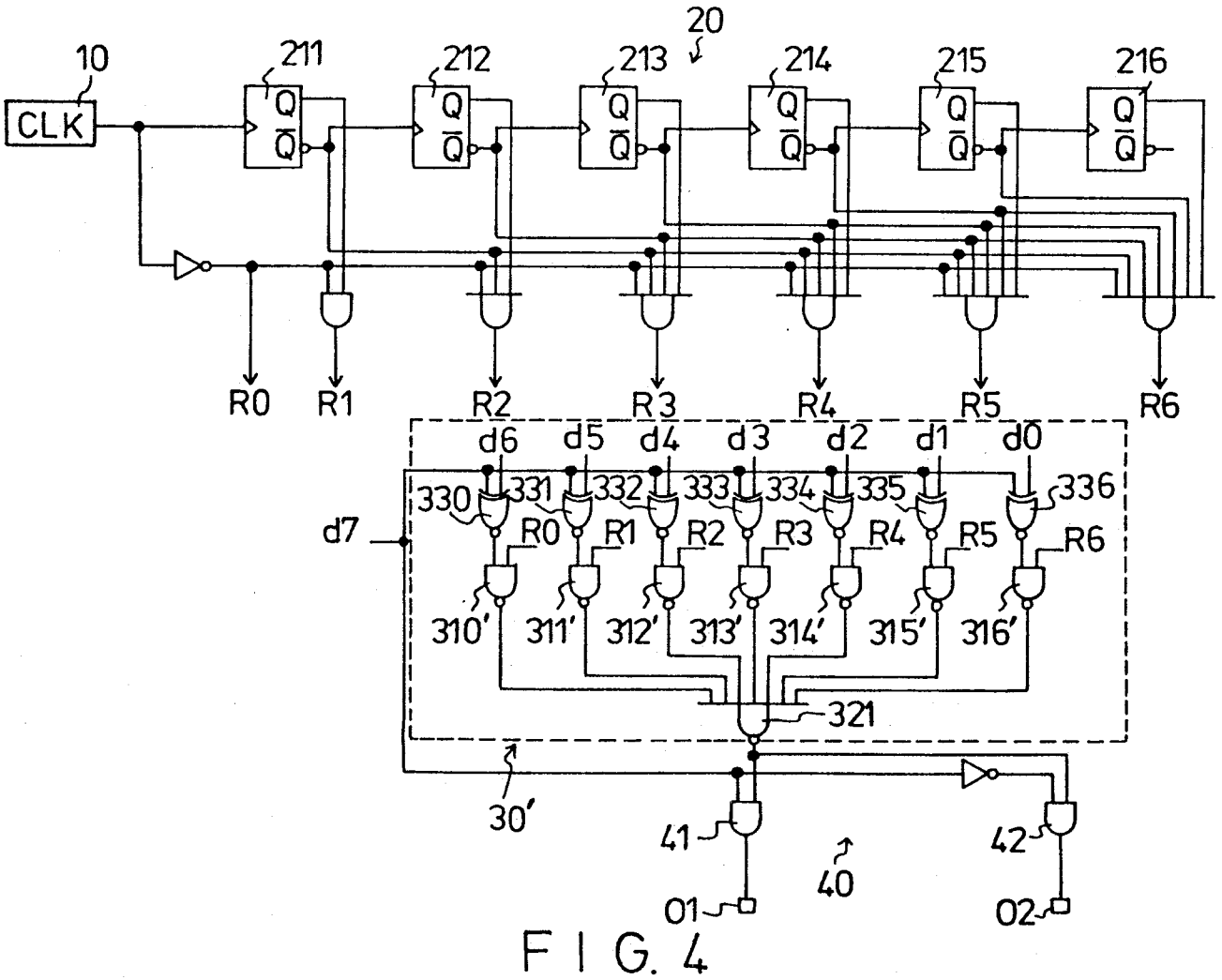
FIG. 4 is a schematic electrical circuit diagram of the second preferred embodiment of a pulse rate modulation type piezoelectric crystal driver device of the present invention.

Referring to FIG. 4, the second preferred embodiment of a pulse rate modulation type piezoelectric crystal driver device is shown to be substantially similar to the first preferred embodiment and thus, its construction and operation will not be detailed herein. The main difference between the first and second preferred embodiments resides in the configuration of the mixing circuit means (30, 30'). In the second preferred embodiment, the mixing circuit means (30') comprises seven exclusive NOR logic means (330–336). Each of the exclusive NOR logic means (330–336) has one of the magnitude bits (d6–d0) and the sign bit (d7) as inputs thereto. The outputs of the exclusive NOR logic means (330–336) are the inverse of the corresponding magnitude bits (d6–d0) when the sign bit (d7) is a logic "0". The mixing circuit means (30') further comprises seven two-input NAND logic means (310'–316'). Each of the logic means (310'–316') has the output of one of the exclusive NOR logic means (330–336) and one of the pulse outputs (R0–R6) as inputs thereto. As with the first preferred embodiment, a seven-input NAND logic means (321) is connected to the outputs of the logic means (310'–316'). The output of the mixer circuit means (30') is received by the AND logic means (41, 42) of the output select circuit means 40.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A pulse rate modulation type piezoelectric crystal driver device for driving a piezoelectric crystal so as to produce sound, comprising:

means for providing a digitized sound signal input which has a sign bit and a plurality of magnitude bits;

a pulse train generator means having a clock pulse output;

means for generating a driving signal by varying the pulse density per unit time of said clock pulse output according to the value of said magnitude bits, said driving signal being more dense when the value of said magnitude bits is higher, said driving signal being less dense when the value of said magnitude bits is lower; and means for applying said driving signal to said piezoelectric crystal so as to permit said piezoelectric crystal to undergo mechanical strain and thereby produce sound, said driving signal generating means comprising a multi-step frequency divider means electrically connected to said pulse train generator means and including a plurality of cascaded flip-flop means which produce a plurality of pulse outputs of diminishing frequency, each of said pulse outputs corresponding to one of said magnitude bits of said digitized sound signal input;

said driving signal generating means further comprising a mixing circuit means having a positive mixer circuit and a negative mixer circuit, said positive mixer circuit including a plurality of first NAND logic means each having one of said magnitude bits and one of said pulse outputs of said frequency divider means as inputs thereto, and a multi-input second NAND logic means electrically connected to said first NAND logic means and having an output to be received by a positive terminal of said piezoelectric crystal, said negative mixer circuit including means for inverting the logic state of said magnitude bits, a plurality of third NAND logic means each having one of the inverted said magnitude bits and one of said pulse outputs of said frequency dividers means as inputs thereto, and a multi-input fourth NAND logic means electrically connected to said third NAND logic means and having an output terminal to be received by a negative terminal of said piezoelectric crystal; and said driving signal applying means comprising an output select circuit means electrically connecting said mixing circuit means and said piezoelectric crystal, said output select circuit means sending one of said output of said second and said fourth NAND logic means to said piezoelectric crystal depending upon the logic state of said sign bit of said digitized sound signal input.

2. The pulse rate modulation type piezoelectric crystal driver device as claimed in claim 1, wherein said output select circuit means comprises first and second AND logic means and means for inverting the logic state of said sign bit, said first AND logic means receiving said output of said second NAND logic means and said sign bit of said digitized sound signal input, said second AND logic means receiving said output of said fourth NAND logic means and the inverted said sign bit from said sign bit inverting means, said first AND logic means having an output terminal connected to said positive terminal of said piezoelectric crystal, said second AND logic means having an output terminal connected to said negative terminal of said piezoelectric crystal.

3. A pulse rate modulation type piezoelectric crystal driver device for driving a piezoelectric crystal so as to produce sound, comprising:

means for providing a digitized sound signal input which has a sign bit and a plurality of magnitude bits;

a pulse train generator means having a clock pulse output;

means for generating a driving signal by varying the pulse density per unit time of said clock pulse output according to the value of said magnitude bits, said driving signal being more dense when the value of said magnitude bits is higher, said driving signal being less dense when the value of said magnitude bits is lower; and means for applying said driving signal to said piezoelectric crystal so as to permit said piezoelectric crystal to undergo mechanical strain and thereby produce sound, said driving signal generating means comprising a multi-step frequency divider means electrically connected to said pulse train generator means and including a plurality of cascaded flip-flop means which produce a plurality of pulse outputs of diminishing frequency, each of said pulse outputs corresponding to one of said magnitude bits of said digitized sound signal input;

said driving signal generating means further comprising a mixing circuit means including a plurality of exclusive NOR logic means each having one of said magnitude bits and said sign bit as input thereto, a plurality of first NAND logic means each having the output of one of said exclusive NOR logic means and one of said pulse outputs of said frequency divider means as inputs thereto, and a multi-input second NAND logic means and having an output signal received by said driving signal applying means; and said driving signal applying means comprising an output select circuit means electrically connecting said mixing circuit means and said piezoelectric crystal, said output select circuit means sending said output signal of said driving signal generating means to either said positive terminal or said negative terminal of said piezoelectric crystal depending upon the logic state of said sign bit of said digitized sound signal input.

4. The pulse rate modulation type piezoelectric crystal driver device as claimed in claim 3, wherein said output select circuit means comprises first and second AND logic means and means for inverting the logic state of said sign bit, said first AND logic means receiving said output signal of said second NAND logic means and said sign bit of said digitized sound signal input, said second AND logic means receiving said output signal of said second NAND logic means and the inverted said sign bit from said sign bit inverting means, said first AND logic means having an output terminal connected to said positive terminal of said piezoelectric crystal, said second AND logic means having an output terminal connected to said negative terminal of said piezoelectric crystal.

* * * * *